United States Patent [19]

Marchot

[11] 4,033,086

[45] July 5, 1977

[54] STRUCTURAL MEMBER FOR LOAD-BEARING PARTITIONS OR WALLS OF BUILDINGS

[76] Inventor: Jules Albert Marchot, Avenue des Hauts Taillis, 5, B-1330 Rixensart, Belgium

[22] Filed: Sept. 4, 1975

[21] Appl. No.: 610,370

[30] Foreign Application Priority Data

| | | |
|---|---|---|
| Sept. 11, 1974 | Belgium | 148435 |
| Apr. 10, 1975 | Belgium | 155273 |
| July 15, 1975 | Belgium | 158336 |

[52] U.S. Cl. ..... 52/656

[51] Int. Cl.[2] ..... E04B 2/74

[58] Field of Search ..... 52/90, 92, 220, 223, 52/238, 235, 244, 281, 474, 475, 476, 488, 489, 752, 758 R, 758 F, 239, 656, 658; 160/135; 211/182, 189; 248/188.7

[56] References Cited

UNITED STATES PATENTS

| | | | |
|---|---|---|---|
| 1,376,895 | 5/1921 | Murname | 52/657 |
| 2,529,008 | 11/1950 | Flory | 52/658 |
| 2,562,022 | 7/1951 | Duer | 248/188.7 |
| 2,634,867 | 4/1953 | Shields | 52/658 X |
| 3,243,051 | 3/1966 | Ruhnke | 211/182 |
| 3,332,374 | 7/1967 | Ferdinand et al. | 211/182 X |
| 3,713,474 | 1/1973 | Orlando | 52/239 X |
| 3,725,995 | 4/1973 | Sharp et al. | 52/656 |
| 3,863,875 | 2/1975 | Olson | 211/182 X |

FOREIGN PATENTS OR APPLICATIONS

| | | | |
|---|---|---|---|
| 503,350 | 4/1939 | United Kingdom | 160/135 |

*Primary Examiner*—J. Karl Bell

*Attorney, Agent, or Firm*—Sughrue, Rothwell, Mion, Zinn & Macpeak

[57] ABSTRACT

A load bearing partition for a wall is formed by a structural member of skeleton construction consisting of a frame formed of laterally spaced vertical uprights and vertically spaced horizontal cross members with the uprights and cross members formed of a sole tubular metal metal section which is bent at the corners of the frame and butt welded at its ends with vertical struts connecting the cross members of the frame and formed of the same type of tubular metal section as the uprights and cross members with their ends welded to the cross members, the uprights, the cross members and the struts being of rectangular shape in cross-section rounded at their edges and reinforced by longitudinal depressions on all four sides intermediate of the rounded corners.

10 Claims, 12 Drawing Figures

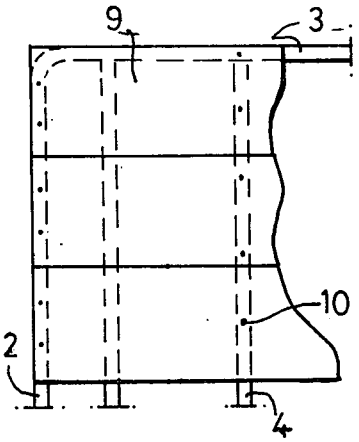
FIG. 3
FIG. 4
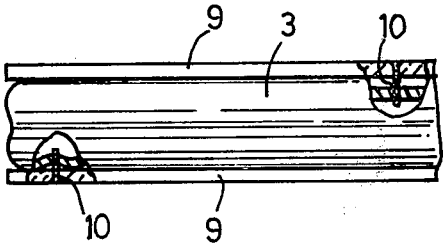
FIG. 6
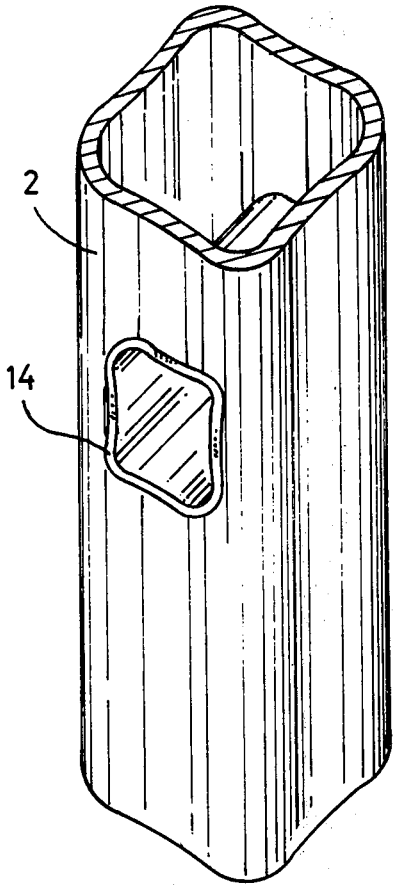
FIG. 5
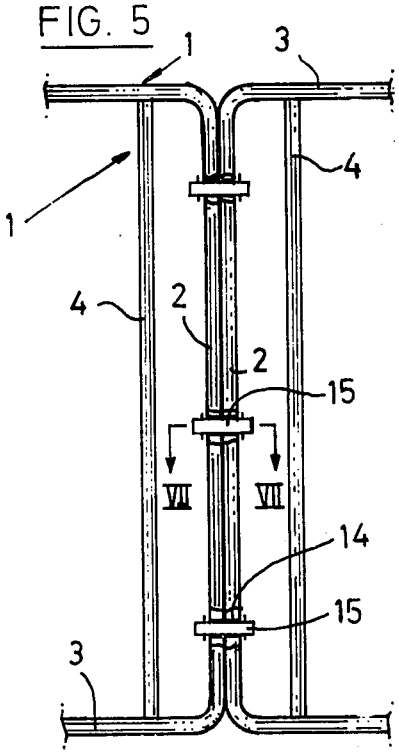
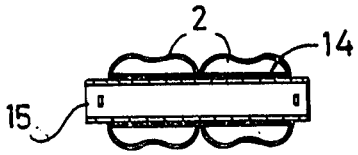
FIG. 7

FIG. 8
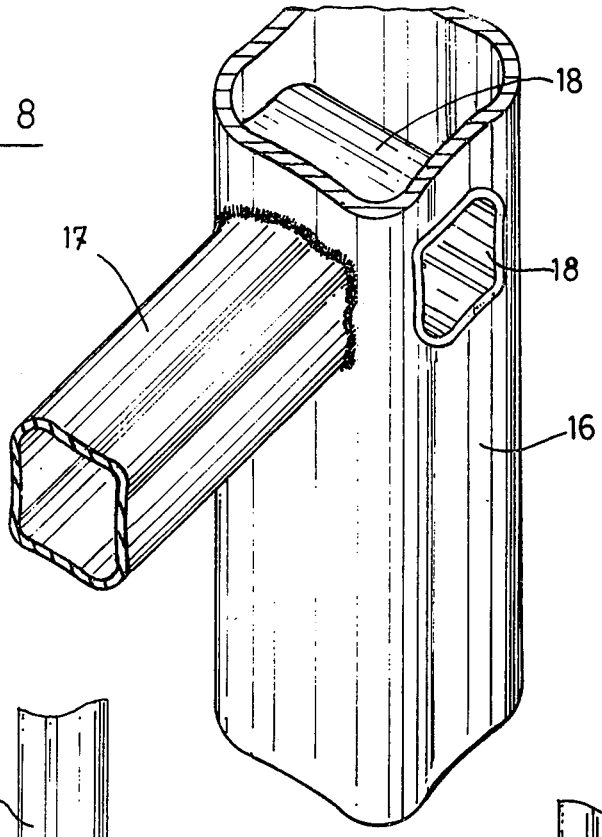
FIG. 10
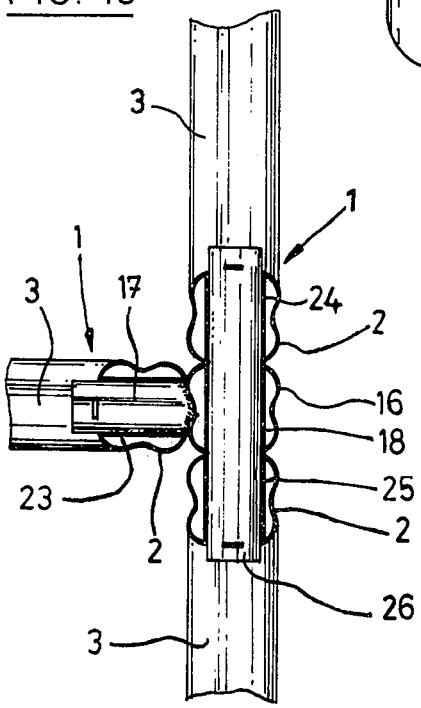
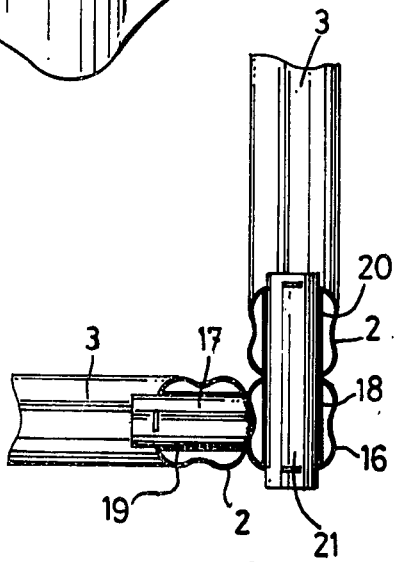
FIG. 9

STRUCTURAL MEMBER FOR LOAD-BEARING PARTITIONS OR WALLS OF BUILDINGS

The present invention relates to structural members for load-bearing partitions or walls of buildings.

There are in existence various structural members, each of which consists of a frame fabricated from metal sections, the frame including infilled portions, such as solid panels in or between which are interposed layers of insulating material. Each such frame is positioned between a floor and a ceiling of a building and is secured in position by screw jacks, for example, so as to form a movable or permanent interior partition. The resulting partition does not take up any load and is always non-load-bearing.

On the other hand, the load-bearing partitions or walls in conventional buildings are usually built of masonry or are built into a framework formed of interlinked sealed joists.

The invention relates to a completely novel structural member intended mainly for buildings such as bungalows, one-storey villas, and garages.

The invention provides a structural member for a load-bearing partition or wall, comprising a skeleton consisting of a frame fabricated throughout from the same type of tubular metal section and reinforced by vertical or oblique struts connecting the cross-members of the frame.

Fabricated in this way, the structural member has a high buckling resistance owing to its framework composed of tubular metal sections and braced vertically or obliquely. The structural member is moreover relatively light and easily handled on the work site. Furthermore, the structural member can be manufactured cheaply from a single type of metal section for example.

With the object of standardizing the constituents of the skeleton of the structural member, the struts may with advantage be of the same tubular metal section as that constituting the frame.

In practice, in order to facilitate manufacture of the frame whilst at the same time rendering the frame especially rigid and strong, it is preferable to bend round the tubular metal section where the cross-members meet the uprights of the frame, the ends being butt-welded.

In order to ensure torsional resistance of the uprights and of the struts of the frame the tubular metal section is preferably of generally polygonal shape, e.g., square or rectangular. In particular, the walls of the tubular metal section may be provided with a slight longitudinal reinforcement along their centre line, whilst the corners of the section are rounded off.

In order to reinforce the skeleton, the tubular metal section of the frame, and optionally the metal sections of the struts, may be charged with a mass of filler material. This mass of filler material is preferably in a state of compression, occupying a volume less than its free volume corresponding to its equilibrium state, and is bonded to the tube section. In this way, the tube section and the filler in combination are better adapted to resist external stresses. In general, the filler material is a synthetic polymerizable material, which is cooled down in the tube section and the volume of which increases when it cools and polymerizes.

It is also possible to reinforce the frame by means of at least one external ligature extending around at least part of its periphery. The external ligature, under slight tension, bears against the external walls of the uprights and cross-members and extends along the central (optionally reinforced) portion of the external walls. The ends of the external ligature are bonded to the external walls if the ligature extends around a portion only of the periphery of the frame; they are bonded to the exterior walls and/or are bonded together, if the ligature extends around the whole of the periphery. With the same object in view, the frame may also be reinforced around at least part of its periphery by at least one internal ligature mounted under slight tension within the tubular sections and resting against the internal walls of the uprights and of the cross-members, in at least one marginal portion of these interior walls. The ends of the internal ligature are bonded to these internal walls if the ligature extends around only a portion of the periphery of the frame; they are bonded to the internal walls and/or are bonded together, if the ligature extends around the whole of this periphery. If required, the external or internal ligature can be fixed at various points between its ends to the external or internal walls of the frame. In practise, the external or internal ligature is preferably a high-tensile steel wire.

For the purpose of making a partition, both sides of the skeleton are entirely covered.

The invention also provides an assembly of two or three of the above-described structural members lying in one plane or following a simple right-angle or a double-right-angle.

In an assembly of two structural members edge-to-edge in a single plane, adjacent uprights of the frames of the two structural members are each equipped with coaxial horizontal tubular sleeves at two different levels at least, the sleeves having a cross-section similar to that of the tubular section from which the frames are made. Rectilinear fastening members, having a cross-section of the same shape as but slightly smaller than that of the sleeves are passed through the respective sleeves. These fastening members fix together the adjacent uprights in question.

In the assembly of two structural members edge-to-edge at a simple right-angle, use is made of a vertical connecting member formed of a tubular metal section the same as or similar to that of the frames of the two structural members, the connecting member being mounted against the adjacent uprights of these frameworks. The connecting member has, on one side only, at two different levels at least, horizontal tubular lateral projections having a cross-section similar to that of the metal section of the frames. These projections engage respectively in horizontal tubular sleeves of corresponding cross-section, which are made in the vertical upright of one of the frames in order to fix this upright to the connecting member. The upright of the other frame and the connecting member each include, at two different levels at least, coaxial horizontal tubular sleeves having a cross-section similar to that of the metal section of the frameworks, through which sleeves are passed respectively rectilinear connecting elements of suitable cross-section (which is slightly smaller than that of these last-mentioned sleeves). These connecting elements fasten together the connecting member and the upright of this other frame.

In the case of the assembly of three structural members at a double right-angle, use is also made of a vertical connecting member formed from a tubular metal section which is the same as or similar to those of the frames of the three structural members, the connecting member being mounted between the adjacent vertical uprights of the frames. The connecting member is provided on one side near the middle of the assembly, and at two different levels at least, with horizontal tubular lateral projections having a cross-section similar to that of the metal section of the frames. these lateral projections engage respectively in horizonta tubular sleeves of corresponding cross-section, which are fabricated in the upright of the middle frame, so as to fasten together this upright and the connecting member. The connecting member and the uprights of the other two frames each include at two different levels at least, coaxial horizontal tubular sleeves each of cross-section similar to that of the metal section of the frames. Into these respective sleeves are passed rectilinear connecting elements of a corresponding cross-section slightly smaller than that of the last-mentioned sleeves. These connecting elements fasten together the connecting member and the uprights of these two other frames.

The invention will be described further, by way of example only, with reference to the accompanying drawings, in which:

FIG. 3 is a diagrammatic front elevation of part of the structural member, whose skeleton has been provided with a covering;

FIG. 4 is a partial sectional plan view illustrating the fixing of the covering;

FIG. 5 is an elevation of part of the skeletons of two structural members, which are in alignment in one plane and are connected together;

FIG. 6 is a perspective view of a portion of an upright of the frame of the skeleton, the upright having been modified for fitting to a similar adjacent upright;

FIG. 7 is a horizontal section through the two adjacent interconnected uprights, along the line VII-VII in FIG. 5;

FIG. 8 is a perspective view of a portion of a vertical connecting stub showing means enabling two or three adjacent uprights of the frames of two or three structural members to be connected together at a single or double right-angle;

FIG. 9 is a plan sectional view of the angle of the frames of two structural members, illustrating the means of assembly at a simple right-angle;

FIG. 10 is a similar plan section view in the angle of the frames of three structural members, illustrating the means of interconnection at a double right-angle;

In the various Figures, like parts are designated by like reference numerals.

The structural member illustrated is used to fabricate a load-bearing partition or wall of a building, i.e., a partition or a wall adapted to withstand heavy loads, applied principally to the upper part thereof. The structural member is designed and manufactured above all to resist buckling under compressive loads such as are met in buildings.

The structural member includes a skeleton consisting of a metal frame 1, having two vertical uprights 2 and two horizontal cross-members 3, which is reinforced by vertical struts 4 connecting the cross-members 3.

Figure 2:
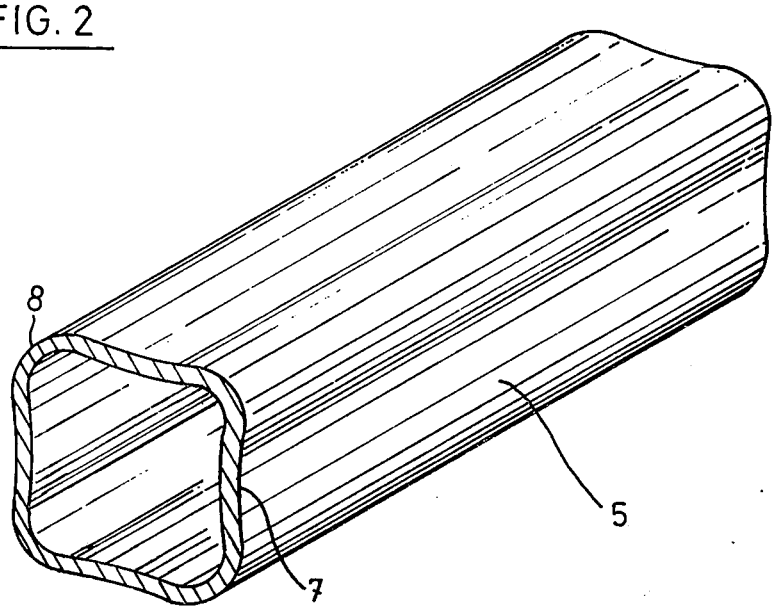
FIG. 2 is a perspective view of the metal section from which the skeleton is fabricated.
Figure 1:
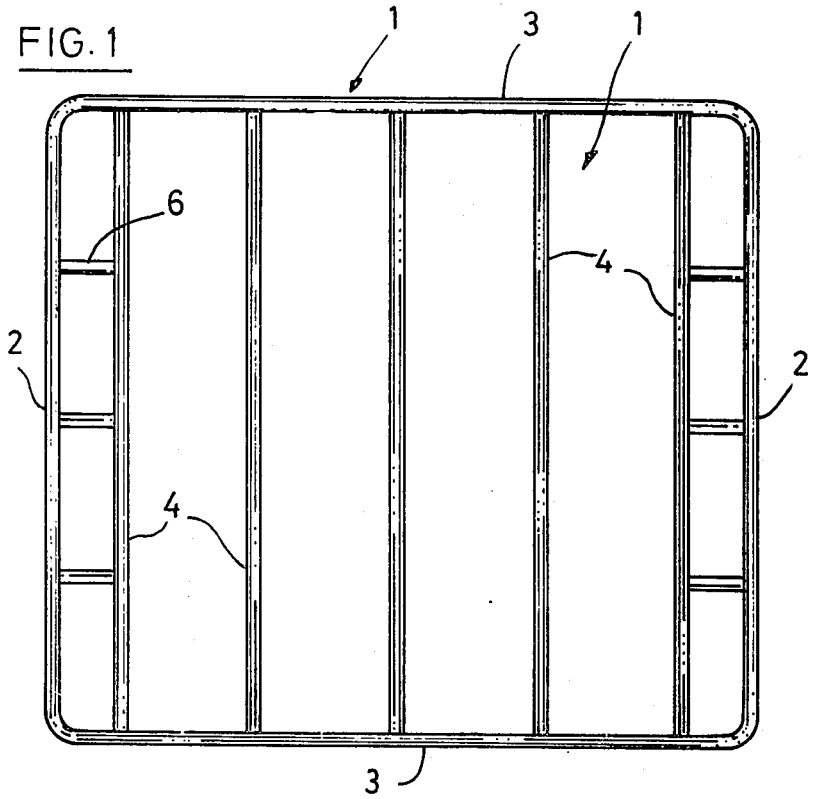
FIG. 1 is a front elevation of the skeleton of a first embodiment of a structural member for a partition or wall.
Figure 11:
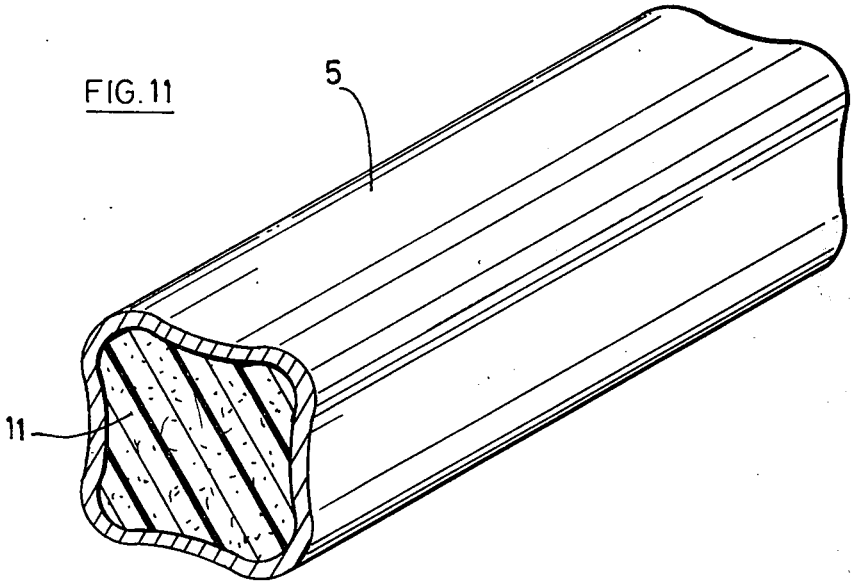
FIG. 11 is a perspective view analogous to that of FIG. 2 showing the metal section of a second embodiment of structural member.
Figure 12:
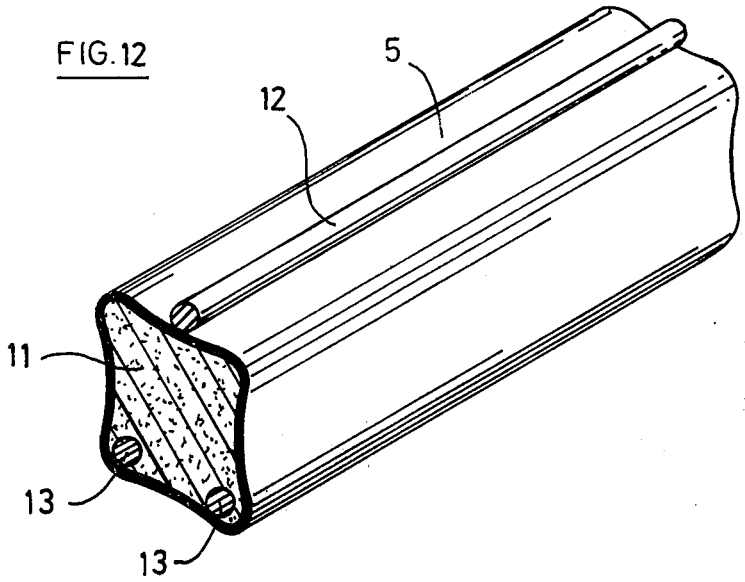
FIG. 12 is a further perspective view similar to that of FIG. 2 showing part of the frame of a third embodiment of structural member.

The uprights 2 and the cross-members 3 are formed of the same tubular metal section 5 clearly shown in one of FIGS. 2, 11, and 12. The metal section 5 is bent round four times in succession at a right-angle, in the same direction, and the ends are butt-welded so as to produce the frame 1.

The struts 4 are also formed of a tubular metal section identical in cross-section with the metal section 5 and their ends are welded to the cross-members 3. The struts 4 are mutually equidistant. The end struts 4 also extend relatively close to the uprights 2 and are connected to them by short horizontal connecting bars 6 which can also be made from stubs of metal section identical to the metal section 5. However, the struts 4 can alternatively be made in at least some cases from a different metal section which is not necessarily tubular and they may even by made from wooden beams. Moreover, some at least of the struts 4 may run obliquely instead of being vertical.

Although, in general, any type of tubular metal section is suitable for fabricating the frame, a metal section of generally polygonal (particularly square or rectangular) shape is preferable. Advantageously the section 5 is of substantially square cross-section. As may be seen from the drawings, the walls of the metal section 5 are slightly reinforced or stiffened (by a longitudinal depression) in the middle longitudinal portion 7 thereof, whilst the corners 8 of this metal section 5 are rounded off smoothly. This particular shape of the cross-section of the metal section 5 not only ensures rigidity and strength of the skeleton, but also ease of positioning and fixing (on the front walls of the uprights 2, of the cross-members 3, and of the struts 4) of a cladding or other covering, so as to constitute the complete structural member.

The covering selected depends on the nature of the partitions and walls under construction.

Thus, for example, in the case of an interior wall, the cladding for each of the two sides of the skeleton may consist of a prefabricated sheet 9, e.g., of plasterboard, mounted on an insulating panel so as to be fixed to the frame 1, for example by metal screws 10 (FIGS. 3 and 4). (The cladding for interior walls may obviously be different from that just described and may be fixed to the frame 1 by other fixing elements or may even be fixed to the frame by adhesive.)

In the case of an exterior wall, on the other hand, the cladding for the external face of the frame 1 consists of any kind of facing applied directly or indirectly to the framework of the building. More particularly, a sheet of asbestos cement may be used which is adapted to receive a keying layer for an outer covering such as tiling or chequer brickwork. The cladding for the internal face of an external wall is the same as that for an internal wall.

In the case of the second embodiment of structural member (FIG. 11), the metal section 5 (of the uprights 2, of the cross-members 3, and of the struts 4) is charged internally with a filling composition adhering to the internal surface of the walls of the metal section and acting in particular to improve even slightly the strength of the skeleton.

The filling composition consists of a synthetic polymerizable composition 11, for example of polyurethane or of a highly concentrated polyester. The composition 11 is injected at high temperature into the metal section 5 and is cooled therein so that the volume increases during the polymerization. As it tends towards its state of solid equilibrium, the synthetic composition 11 maintained under a reduced volume exerts an internal pressure on the walls of the metal section 5, which walls are adapted to resist this pressure, owing in particular to their cross-sectional shape.

The metal section 5 and the filling composition 11 form together a composite framework which behaves like a single metallic member in relation to external stresses in that it is adapted to offer greater resistance to stresses than the metal skeleton alone.

In the third embodiment of structural member (FIG. 12), the framework 1 is reinforced by an external ligature 12 and by two identical parallel internal ligatures 13. The external ligature 12 and each internal ligature 13 are preferably of high-tensile steel wire.

The external ligature 12 extends around the entire periphery of the frame 1 and is applied under a slight tension against the exterior walls of the frame 1. The exterior ligature 12 is advantageously positioned along the central reinforced portions of the exterior walls in question. The extremities of the exterior ligature 12 are fastened together and/or are fastened to the external walls of the frame 1, for example by welding. The exterior ligature 12 is also fixed between its ends to the exterior walls of the frame 1 at regularly spaced points.

Each one of the interior ligatures 13 extends within the tubular section 5 around the whole periphery of the frame 1 and is also applied under slight tension against the internal surfaces of the interior walls of the uprights 2 and of the cross-members 2 of the frame 1. The interior ligatures 13 are therefore located in the interior of the frame 1 and are, moreover, located respectively in the marginal portions of the interior walls of the frame. The ends of each interior ligature 13 are fastened together and/or are fastened to the interior walls. Moreover, each interior ligature 13 is fastened, between its extremities, to the interior walls of the frame 1 at regularly spaced points.

In the arrangement just described, the exterior ligature 12 and the interior ligatures 13 encompass the external walls and internal walls respectively of the frame 1. However, the ligatures 12 and 13 may alternatively extend over a portion only of the framework 1. In this case, the ends of the ligatures are fixed, for example by welding, to the corresponding walls of the frame 1.

Two structural members (as described above) are put together in the same vertical plane and in the same horizontal alignment by the mutual juxtaposition and fastening together of their frames 1 (FIGS. 5 to 7). Corresponding uprights 2 of the frames 1 are placed close together, the uprights 2 both including, at two different levels at least (for example at three different levels), apertures having a cross-section similar to that of the metal section 5 but of smaller size. These horizontal apertures serve to locate identical horizontal tubular sleeves 14 each of which consists of a stub of tube section of similar cross-sectional shape to the metal section 5 but of smaller dimensions. The sleeves 14 are secured to the uprights 2, for example by welding.

During the assembly of the frames 1, the sleeves 14 are arranged coaxially in pairs and each pair defines a channel into which is forced a rectilinear connector 15 consisting of a stub of metal section similar to that of the sleeves 14 but slightly smaller. The tight fitting of the three connectors 15 in the sleeves 14 ensures that the respective uprights 2 of the frames 1 are securely fastened together.

For the horizontal assembly of two structural members at a simple right-angle (FIGS. 8 and 9) use is made of a vertical connecting member 16 which is preferably formed from a metal section identical with that of the metal section 5. The connecting member 16 includes at two different levels at least, on the one hand, tubular lateral projections 17 on one wall, and on the other hand, coaxial apertures in the two adjacent opposite walls. Each horizontal projection 17 consists of a stub of metal section similar to the metal section 5 but of smaller dimensions. Each projection 17 is welded to the connecting member 16. On the other hand, the apertures in the member 16 serve to locate the horizontal sleeves 18 passing through this connecting member from one side to the other. Each sleeve 18 is fixed (for example by welding) to the connecting member 16. Each sleeve 18 is also formed from a stub of metal section similar to the metal section 5 but of smaller dimensions.

In order to assemble frames 1 at a simple right-angle, the adjacent uprights 2 include when adjusted, apertures at the same levels as the projections 17 and the sleeves 18 of the connecting members 16, through which pass other horizontal sleeves 19 and 20 which are identical to the sleeves 18.

During the assembly at a simple right-angle of the frames 1, the uprights 2 are placed in position against the connecting member 16. The projections 17 of the member 16 are forced into the sleeves 19 of an upright 2. The sleeves 18 of the connecting member 16 are located coaxially with the sleeves 20 of the other upright 2, so that rectilinear connectors 21 can be forced into the sleeves. The connectors 21 are also formed of metal section stubs having a cross-sectional shape similar to that of the sleeves 20 but of slightly smaller cross-section. The connectors 21 are identical in sectional dimensions to the projections 17. The forcing of the projections 17 of the connecting member 16 into the sleeves 18 on the one hand, and of the connector 21 into the sleeves 19 and 20 on the other hand, ensures that the two frames 1 are effectively connected together.

The horizontal assembly of three structural members in a double right-angle is also effected by means of the connecting member 16. In this case, the three adjacent uprights 2 of the frames 1 include, at two different levels at least, apertures through which pass identical horizontal sleeves 23, 24, and 25. During the assembly of the three frames 1, the three uprights 2 are placed in contact with the connecting member 16, as shown in FIG. 10.

The projections 17 of the connecting member 16 are moreover forced into the sleeves 23 of the middle frame 1. Furthermore, the sleeves 24 and 25 of the two other outermost frames 1 are located coaxially with the sleeves 18 of the connecting member 16 and connectors 26 are forced into these sleeves 24 and 25. The insertion of the projections 17 in the sleeves 23 and that of the connectors 26 in the sleeves 24 and 25 ensures the effective connection of the three frames 1.

The assembly thus made of the structural members may be either movable or fixed and either temporary or permanent.

The structural members assembled together may form structures of modular volume which can be positioned horizontal and/or vertically. In this way, structures positioned horizontally may assume a considerable variety of arrangements in the form of an L, a T, a U, or a Z-shaped arrangement of the rooms of a bungalow or of one storey of a building. On the other hand, structures arranged vertically may also assume different configurations, notably as parallelepipeds and pyramids.

The structural members assist in the fabrication of load-bearing partitions or walls and of building modules owing to the metal sections 5 which are used, which are resistant to bending and to torsion, and which are resistant to buckling under load owing to their frame 1 with rounded corners and moreover owing to their vertical reinforcing struts 4 and are able to sustain these applied loads owing to the metal sections used and the systems employed for assembling the frames 1.

It will be obvious that the invention is not exclusively limited to the embodiments shown and that modifications can readily be made in the shape, arrangement and constitution of their components, within the scope of the appended claims.

What I claim:

1. In a load-bearing partition or wall for a building or the like, a structural frame forming a skeleton and comprising two vertical uprights, two horizontal cross-members and a plurality of laterally spaced vertical struts connecting the frame cross-member, said uprights and cross-members being fabricated throughout from a single tubular metal section which is bent at each corner of the frame and which is butt-welded to itself at its ends, said struts being of the same type tubular metal section as that of the uprights and cross-members, with the ends of the struts being welded to said cross-members, the tubular metal section of the uprights, the cross-members and the struts having identical cross-section with said tubular section being of rectangular cross-sectional configuration with the longitudinal walls to the tubular section being reinforced by longitudinal depressions within the middle of the walls and extending towards the hollow tubular interior, and wherein the corners of said tubular section walls being rounded to impart high strength to said frame to effectively withstand bending stresses and compression stresses when subjected to building loads.

2. In a load-bearing partition or wall, a structural member as claimed in claim 1, in which the tubular sections of the frame members are filled with a filler composition made from a polymerizable synthetic material which increases in volume during polymerization and which is under compression and adheres to the tubular section after polymerization.

3. A structural member as claimed in claim 1 in which the tubular section of the frame contains a filler composition which is under compression and which adheres to the tubular section.

4. A structural member as claimed in claim 2, in which the filler composition is made from a polymerizable synthetic material which increases in volume during polymerization.

5. A structural member as claimed in claim 1, in which each of the two sides of the frame is covered over its entire area.

6. A structural member as claimed in any of claim 1, in which the tubular section is of polygonal shape.

7. A structural member as claimed in claim 6, in which the walls of the polygonal tubular section are reinforced in their middle longitudinal portion and the corners of the tubular section are rounded.

8. An assembly comprising two structural members according to claim 1, connected together edge-to-edge in a single plane, in which the adjacent uprights of the frames of the two structural members each include coaxial horizontal tubular sleeves at two different levels, at least, the sleeves having a cross-section similar to that of the tubular section forming the frames, the sleeves receiving rectilinear connectors having an external cross-section similar to but slightly smaller than the internal cross-section of the sleeves, the connectors passing through the sleeves and fastening together the adjacent uprights.

9. An assembly comprising two structural members according to claim 1 connected together edge-to-edge at right-angles, the assembly further comprising a vertical connecting member formed by a tubular metal section similar to that of the frames of the two structural members, the connecting member being placed against the adjacent uprights of the frames, the connecting member having, at two different levels at least, lateral horizontal tubular projections having a cross-sectional shape similar to that of the tubular section of the frame, the projections engaging respectively in horizontal tubular sleeves of corresponding cross-sectional shape with which the adjacent upright of one of the frames in order to connect together this upright and the connecting member, the adjacent upright of the other frame and the connecting member each including, at two different levels at least, coaxial horizontal tubular sleeves each having a cross-sectional shape similar to that of the tubular section of the frame, the sleeves being traversed respectively by rectilinear connectors having an external cross-section similar to but slightly smaller than the internal cross-section of these sleeves, the connectors firmly connecting together the connecting member and the upright of this frame.

10. An assembly comprising three structural members according to claim 1, with three edges adjacent, one member being at right-angles to the other two, which are co-planar, the assembly further comprising a connecting member formed by a tubular metal section similar to that of the frames of the three structural members and placed against the adjacent uprights of the three frames, the connecting member comprising on the side facing the middle assembly, at two different levels at least, horizontal tubular lateral projections having a cross-sectional shape similar to that of the tubular section of the frames, the lateral projections engaging respectively in horizontal tubular sleeves of corresponding cross-section with which the adjacent upright of the middle frame is provided, in order to interconnect this upright and the connecting member, the connecting stub and the adjacent uprights of the two other, co-planar frames each including, at two different levels at least, coaxial horizontal tubular sleeves having a cross-section shape similar to that of the tubular section of the frames, these sleeves being traversed respectively by rectilinear connectors having a cross-section similar to but slightly smaller than that of the sleeves, these connectors connecting together the connecting member and the adjacent uprights of the said other two frames.

* * * * *